US007798772B2

(12) United States Patent
Bross et al.

(10) Patent No.: US 7,798,772 B2
(45) Date of Patent: Sep. 21, 2010

(54) CENTRIFUGAL PUMP INTAKE CHANNEL

(75) Inventors: Stephan Bross, Erpolzheim (DE); Isabel Goltz, Goslar (DE); Peter Amann, Birkenheide (DE)

(73) Assignee: KSB Aktiengesellschaft, Frankenthal (DE)

( * ) Notice: Subject to any disclaimer, the term of this patent is extended or adjusted under 35 U.S.C. 154(b) by 1078 days.

(21) Appl. No.: 11/154,590

(22) Filed: Jun. 17, 2005

(65) Prior Publication Data

US 2005/0265866 A1 Dec. 1, 2005

Related U.S. Application Data

(63) Continuation of application No. PCT/EP03/011721, filed on Oct. 23, 2003.

(30) Foreign Application Priority Data

Dec. 17, 2002 (DE) ..... 102 58 922

(51) Int. Cl.
*F04D 29/68* (2006.01)
*F04D 29/40* (2006.01)

(52) U.S. Cl. ..... 415/185; 415/173.1; 415/189

(58) Field of Classification Search ..... 415/57.1, 415/57.3, 57.4, 173.1, 173.5, 183, 185, 189, 415/208.2, 220, 914; 416/DIG. 2
See application file for complete search history.

(56) References Cited

U.S. PATENT DOCUMENTS 1,693,352 A * 11/1928 Schmidt ..... 241/101.5
4,239,453 A 12/1980 Hergt et al.
5,785,495 A 7/1998 Springer et al.
6,514,034 B2 * 2/2003 Okamura et al. ..... 415/58.5
6,540,482 B2 * 4/2003 Irie et al. ..... 415/221
6,736,594 B2 * 5/2004 Irie et al. ..... 415/128
6,767,185 B2 * 7/2004 Martin et al. ..... 415/205
2002/0041805 A1 4/2002 Kurokawa et al.

FOREIGN PATENT DOCUMENTS

DE 79 24 976 U1 5/1981
DE 25 58 840 C2 3/1983
DE 101 05 456 A1 8/2002
EP 1 069 315 A2 1/2001
EP 1 191 231 A2 3/2002
EP 1 270 953 A1 1/2003

OTHER PUBLICATIONS

People's Republic of China Office Action dated Jun. 1, 2007 including English translation (Eight (8) pages).
International Search Report, Application No. PCT/EP03/11721, dated Feb. 13, 2004.

* cited by examiner

*Primary Examiner*—Edward Look
*Assistant Examiner*—Nathaniel Wiehe
(74) *Attorney, Agent, or Firm*—Crowell & Moring LLP

(57) ABSTRACT

A centrifugal pump with a housing having one or more impellers having an axial or semiaxial, open or closed design disposed therein and an intake channel mounted upstream of the first impeller. A plurality of grooves that are distributed around the circumference and extend in the direction of flow are arranged within the wall area of the intake channel. In the housing wall of the intake channel there is a closed annular wall area constructed between a point of entry of the first impeller and the proximate ends of the grooves, whereby the grooves are operatively connected exclusively with the space in the intake channel.

9 Claims, 4 Drawing Sheets

CENTRIFUGAL PUMP INTAKE CHANNEL

CROSS REFERENCE TO RELATED APPLICATIONS

This application is a continuation of international patent application no. PCT/EP2003/011721, filed Oct. 23, 2003 designating the United States of America, and published in German as WO 2004/055381 on Jul. 1, 2004, the entire disclosure of which is incorporated herein by reference. Priority is claimed based on Federal Republic of Germany patent application no. DE 102 58 922.4, filed Dec. 17, 2002.

BACKGROUND OF THE INVENTION

The present invention relates to a centrifugal pump, which has a housing holding one or more impellers. The impellers may be of axial or semiaxial, closed or open design. An intake channel is arranged in front of a first impeller, and a plurality of grooves distributed around the circumference are provided in the wall face of the intake channel.

In centrifugal pumps which have a high specific velocity, a significant locally limited increase in the respective net positive suction head (NPSH) curve often occurs in the delivery range of 65-80% of the design volume flow. Meanwhile, depending on the pump design, the respective curve of the Q-H characteristic line may additionally have an instability which is referred to in general as a break or discontinuity in the characteristic line or as a saddle.

Such characteristic line shapes are due to the formation of the so-called partial load vortex, which occurs when the volume flow is reduced in the outside range of an impeller intake. A partial load vortex has a significant influence on the oncoming flow to the impeller under which the impeller is subjected to blocking of the meridional flow cross section and experiences a high velocity component in the direction of rotation of the impeller (spiral co-rotation).

U.S. Pat. No. 4,239,453 (=DE 25 58 840) describes an approach for avoiding the disadvantages of a partial load vortex, in which a diffusor is arranged in front of an impeller intake. Using this approach, the direction of action of a partial load vortex is reduced before it can reach the components situated in front of the impeller intake and can cause their destruction.

Other measures for influencing a partial load vortex are described in U.S. Pat. No. 6,290,458 (=EP 1,069,315), particularly in the description of the prior art. The measures "casing treatment, separator or active control" either require additional units in the machine periphery (active control), or reduce the efficiency even at the optimum point of the machine (casing treatment), or are associated with increased structural complexity (separator). This publication itself proposes the use of a plurality of grooves, which are generally referred to as J-grooves in accordance with the published article "An Improvement of Performance-Curve Instability in a Mixed-Flow Pump by J-Grooves," May 29-Jun. 1, 2001, New Orleans, La., FEDSM 2001-18077, Proceedings of 2001 ASME Fluids Engineering Division Summer Meeting (FEDSM '01), because of their curved J shape.

J-grooves are shallow grooves but in another embodiment they may also have a spatial curvature and are provided in the pump housing in the direction of flow upstream from and above the impeller blades which are designed to be open at the impeller intake. The deciding factor for the functionality of the grooves is that they must partially cover the outside diameter of the impeller. In the area of the impeller cover, the impeller must be designed to be open to obtain a connection between a fluid zone provided with a higher pressure in the area of the open impeller blades and the beginnings of the J-grooves provided above that. As a result of this design measure, a fluid-carrying connection to the oncoming flow zone situated upstream is created via the J-grooves. Due to the J-grooves arranged in the main direction of flow, the open impeller wheel blades permanently deliver a partial stream of fluid already pumped upstream from the impeller back into the area of the oncoming flow to the impeller. These J-grooves have the disadvantage that their return flow is always active over the entire operating range of the pump. Consequently, the peak efficiency of a pump equipped with J-grooves declines.

Another disadvantage is the interaction between the free impeller blade tips and the opposing groove parts of the J-grooves fixedly positioned on the housing, which leads to increased noise and vibration phenomena. The passage on page 2 of the aforementioned literature citation in conjunction with FIG. 3 and the respective explanation thereof describes how to reduce these phenomena. To do so, the ends of the J-grooves arranged above the free blade tips are joined together by a peripheral ring groove. Above this ring groove to be provided additionally in the housing, there is an equalization of pressure between the end faces of the individual J-grooves. Furthermore, a high level of manufacturing complexity is required to provide such J-grooves, which are curved in space and extend in the manner of a discontinuity from the intake area into a conical housing wall face with a constant diameter. Thus, this method of influencing the partial load vortex is associated with some major disadvantages.

SUMMARY OF THE INVENTION

The object of the present invention is to provide a simple possibility for improving both the NPSH performance and the partial load performance in centrifugal pumps which have a high specific velocity with impellers of an axial, semiaxial, open or closed design.

Another object of the invention is to provide a simple procedure for subsequently upgrading centrifugal pumps already in use without adversely affecting the operating performance in normal operation of the centrifugal pump.

These and other objects have been achieved in accordance with the present invention by providing a centrifugal pump having a housing containing at least one impeller having an axial or semiaxial, open or closed design and an intake channel positioned in front of the first impeller, a plurality of grooves provided in the wall surface of said intake channel, said grooves being distributed around the channel circumference and extending in the direction of flow, wherein a closed annular wall surface is provided in the housing wall of the intake channel between an impeller intake point of the first impeller and the proximate ends of the grooves, whereby the grooves are operatively connected exclusively with the space in the intake channel.

In accordance with the invention, grooves are provided in the housing wall of the intake channel and a closed annular wall surface is constructed between an impeller intake point of the first impeller and the nearest ends of the grooves, whereby the grooves are in operative connection exclusively to the intake channel. A first impeller is designed as an intake impeller. The closed annular wall surface constructed in the housing wall of the intake channel is situated between the ends of the grooves located upstream from the impeller intake point in the direction of oncoming flow and the impeller intake point of the first impeller. Such an intake impeller may have a specific high velocity $nq \geqq 70\ min^{-1}$.

Due to this approach, the optimum operating point of a centrifugal pump remains unchanged and is not subject to any negative influence. The same is true for the other operating points. A partial load vortex, which develops in partial load operation and is also known as a pre-rotation vortex, however, is diminished with the help of the elongated recesses. The elongated grooves result in an energy transfer by friction from the area of the partial load vortex near the wall to multiple small vortices which develop in the grooves. Due to this energy transfer which occurs only in partial load operation, the circumferential component and thus the intensity of the resulting partial load vortex are drastically reduced and consequently the partial load behavior of the centrifugal pump is improved. Since the grooves manifest their energy-dissipating effect only in conjunction with a partial load vortex separating from the impeller, the oncoming flow to the impeller remains unaffected for the other operating points. There is no negative effect on normal oncoming flow to the impeller and thus there is also no negative effect on the efficiency curve. In contrast with the embodiments known in the past in the form of J-grooves, there is no mixing of the flow conveyed back from the impeller via the grooves with a main flow approaching the impeller.

Due to the deliberate avoidance of any input of high-energy medium into the grooves, any disturbance in the impeller oncoming flow is prevented in normal operation. Only when a disturbance in the form of the developing partial load vortex is induced by the impeller does an interaction begin so to speak between the grooves and the partial load vortex. This interaction leads to a self-regulating effect. In doing so the energy of the partial load vortex is dissipated in the grooves due to the formation of a plurality of small groove vortices, which result in a significant weakening of the partial load vortex. This function can be achieved only when the groove ends in the intake channel upstream from the impeller are reliably cut off from a supply of fluid already being conveyed, and this is accomplished by a closed wall face in the form of an annular or ring-shaped closed wall face.

In accordance with one embodiment of this invention, the grooves are arranged between rib-like projections on the housing wall of the intake channel. In such applications in which machining of an intake channel is impossible, or is possible only with great difficulty, an annular insert which contains the grooves or ribs may also be inserted into an existing intake channel of a pump. Use of such an insert permits simple machining of the grooves, and the insert can be installed without difficulty in the intake channels of newly manufactured pumps or even in pumps that have already been delivered.

Due to the low groove depth, which amounts to only a few millimeters, the grooves being provided only in the area of the borderline areas near the wall, an insert constructed in this way is capable of achieving an improvement, even subsequently, in the partial load performance of centrifugal pumps already shipped or installed in systems. To do so, it may perhaps be necessary to slightly increase the inside diameter of the intake channel in which the insert is received to be able to accommodate a corresponding diameter size of a grooved insert. A type of modular system is used here to permit use of such an insert by virtue of a skilled gradation in diameters in a plurality of types of pumps.

In accordance with another embodiment of the invention, the closed ring-shaped wall surface has an axial length which depends on the intensity of the partial load vortex. The length of the axial surface is at least large enough to reliably suppress any interference between the impeller blades at the impeller intake and the groove ends in front of them. This prevents the development of interfering noises and vibrations in an extremely simple manner. On the other hand, the length of the axial ring face is selected to be not larger than would correspond to the extent of the gradually developing partial load vortex, which is harmless at this point. Only when the developing partial load vortex develops a greater intensity is it possible for its so-called separation line to become detached from the impeller and jump over the closed ring-shaped wall surface. As a result of this, the partial load vortex separates completely from the impeller. It is thereby directed against the oncoming flow and rotates about the machine axis in the direction of rotation of the impeller. Due to the tangential flow over the recesses and the development of multiple small vortices in the recesses, most of the energy in the partial load vortex is dissipated, and the effect of the partial load vortex is drastically reduced.

In accordance with other embodiments of this invention, the closed ring-shaped wall surface has an axial length, which depends on the intensity of the partial load vortex. This axial length is on the order of magnitude of 0.005-0.02 times the diameter of the impeller intake. Furthermore, the lengths of the grooves or ribs are of an order of magnitude of 0.03-0.5 times the diameter of the impeller intake. The depths of the grooves or the heights of the ribs in this case are on the order of magnitude of 0.005-0.02 times the diameter of the impeller intake.

Furthermore, according to another embodiment of this invention, the product of the width b of the groove multiplied by the number n of grooves corresponds to a ratio of:

$$n \cdot b = 0.45 - 0.65 \cdot \Pi \cdot D$$

where D is the impeller intake diameter.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
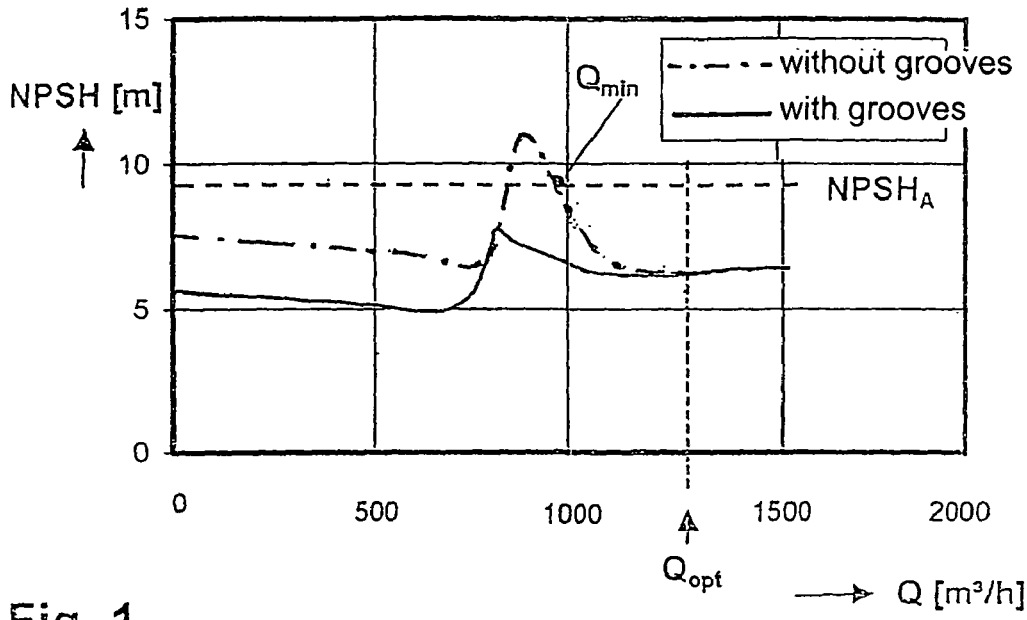
FIG. 1 is a graph showing net positive suction head (NPSH) curves of centrifugal pumps of the aforedescribed type equipped with and without grooves.

FIG. 1 is a diagram showing, as an example, a typical NPSH curve (as a dash-dot line) for centrifugal pumps with high-speed impellers of the axial or semiaxial design. The values for the delivery quantity Q are plotted on the abscissa and the values for the NPSH are plotted on the ordinate. It can be seen here that at the operating point $Q_{opt}$, the optimum point in the delivery rate, the NPSH curve has a low value. In partial load operation, however, the NPSH curve is characterized by a local rise, the so-called NPSH peak, which restricts the operating range at $Q_{min}$ with the predetermined maximum allowed $NPSH_A$ value shown with a dotted line. Operation below this operating point is not allowed because otherwise cavitation-induced states may occur in the pump, which would not allow continuous operation.

Another NPSH curve is shown in the diagram by a solid line, corresponding to a centrifugal pump with the same operating points, but in which grooves arranged according to this invention have additionally been provided in the intake channel of this pump. The shape of the curve determined for a centrifugal pump designed in such a way illustrates convincingly the essentially more favorable NPSH properties. The local rise in NPSH typical of partial load operation still occurs, but is at a much lower level in comparison with a pump without grooves. A pump improved in this way has a greatly expanded operating range.

Figure 2:
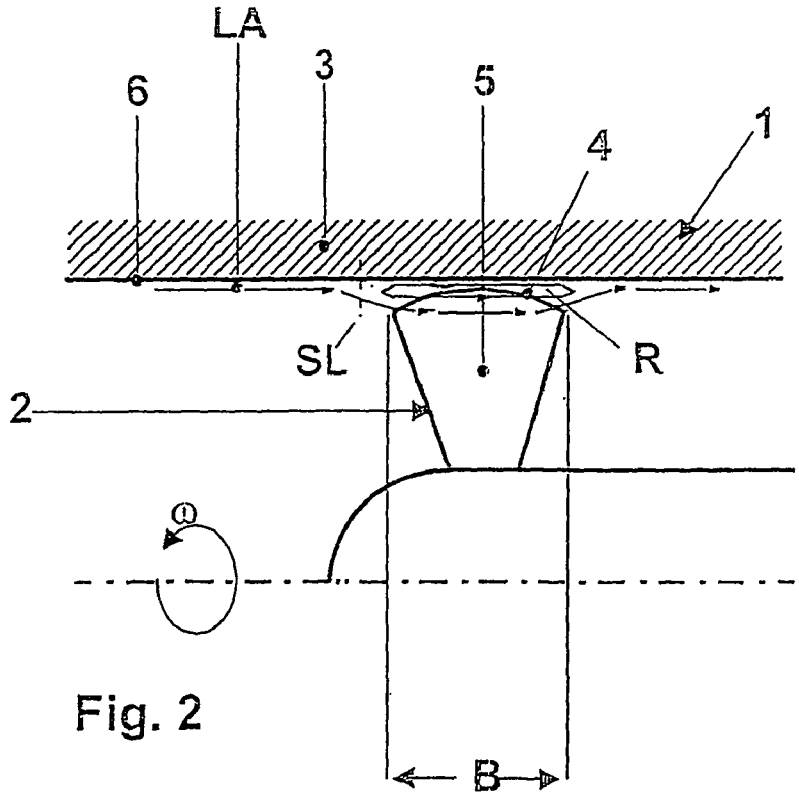
FIG. 2 is a flow diagram of a backflow region of an axial pump with an open impeller in normal operation.

FIG. 2 shows at the optimum point $Q_{opt}$ of a centrifugal pump 1 the prevailing flow conditions for an example of an open axial rotor. An impeller 2 rotates in a housing 3. During the rotational movement of the impeller 2, a return flow region R, which revolves with the impeller, develops in the form of a weak eddy current between the housing 3 and the free blade tips 4 of the impeller 2. This return flow R is due to the pressure exchange between the blade channels adjacent to the flow regions and the pressure equalization between the intake side and the pressure side of blades 5 which occurs during operation of free blade tips 4. Such a return flow region R rotating with the impeller 2 occupies a zone that would correspond approximately to one blade width B.

This return flow region R has a direction of flow along the housing wall 6, as indicated by arrows, running in the opposite direction from the oncoming flow LA to the impeller. A so-called separation line SL is drawn at the location, at which the return flow region R reverses its direction of flow. This is to a certain extent a borderline which runs around the circumference of the housing wall 6. In the area of this line SL the energy of the impeller oncoming flow LA is greater than the energy of the return flow region R and therefore causes its flow reversal. In pumps with open axial or semiaxial impellers, such a return flow region R exists over the entire operating range and also occurs in the range of the optimum efficiency point.

Figure 3:
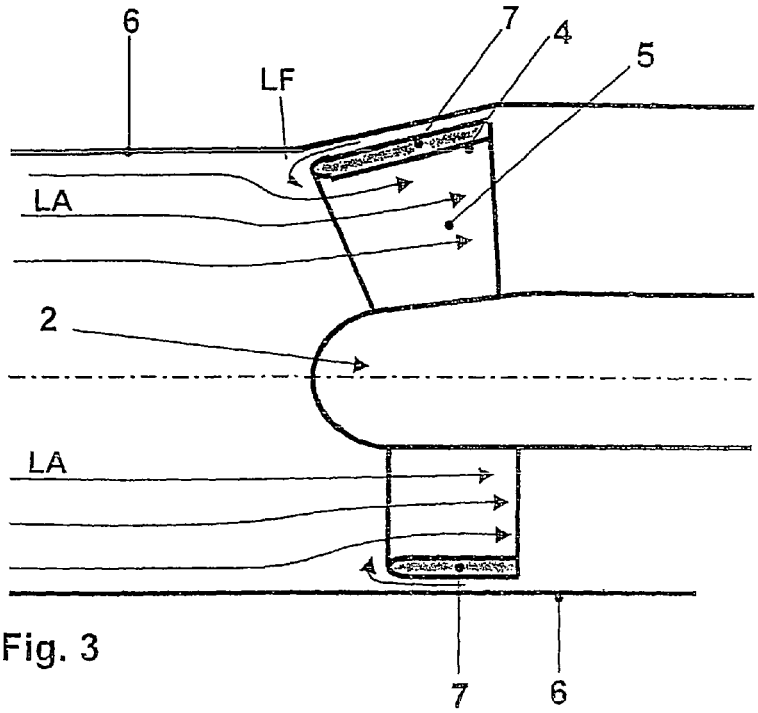
FIG. 3 is a flow diagram of an axial pump and a semiaxial pump with a closed impeller in normal operation.

According to FIG. 3, a similar return flow region occurs with two different designs of closed impellers. The upper diagram in FIG. 3 shows the conditions with a semiaxial pump design, while the lower diagram shows the conditions with an axial pump. With these impellers, a so-called cover disk 7 prevents an exchange of energy via the blade tips 4 and between the intake side and the pressure side of an impeller blade 5. Therefore there is a small gap flow LF between the housing wall 6 and the cover disk 7 with such impellers 2; which is attributable to the pressure difference in front of and behind the impeller. Such leakage losses are drastically reduced through appropriately small gap plays between the cover disk 7 and the housing wall 6.

Figure 4:
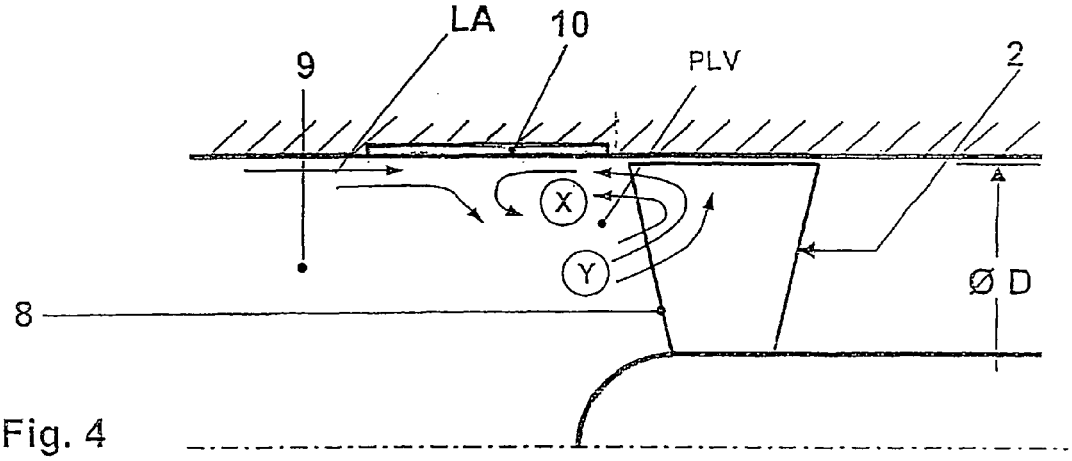
FIG. 4 is a flow diagram of a partial load vortex of an axial pump in partial load operation.

With reference to the example of an open impeller 2, FIG. 4 shows the development of a partial load vortex PLV which occurs in partial load operation. This embodiment and the following embodiments also apply to an impeller of a closed design. A partial load vortex PLV of this type which rotates with the impeller develops at the impeller intake edges 8 in the area of the impeller outside diameter D and emerges from the impeller 2 opposite the oncoming flow to the impeller LA and flows back into the intake channel 9. In the development of the rotating partial load vortex PLV, there is a strong non-steady-state interaction between the impeller oncoming flow and the flow around the blades, which is manifested in particular through an abrupt increase in the NPSH values. The strength of this increase depends on the intensity of the developing partial load vortex. The positions X and Y that are circled in FIG. 4 denote details and are used to depict the velocity triangle in FIG. 5. A plurality of grooves 10 is distributed around the circumference and arranged in the wall surface 6 of the intake channel 9 in front of the impeller 2.

Figure 5:
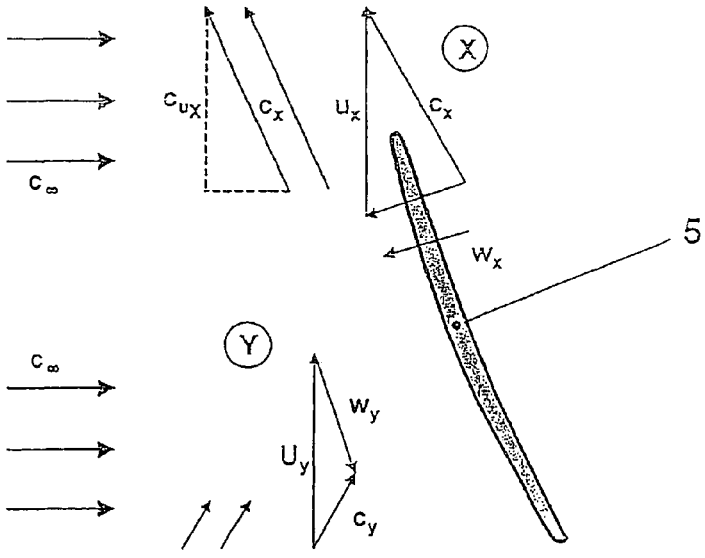
FIG. 5 shows various velocity triangles in a cylinder section of an axial machine upon separation of the partial load vortex from the impeller.

FIG. 5 shows the velocity ratios of a partial load vortex PLV that develops at locations X and Y from FIG. 4. The location X shows the velocity ratios in the area near the wall of the partial load vortex PLV separating from the impeller 2 and the location Y shows the ratios in the area of the partial load vortex PLV remote from the wall entering back into the impeller 2. For this diagram, the velocity triangles composed of the direction vectors and the magnitude vectors for the absolute velocity c, the relative velocity w and the circumferential velocity u, have been drawn in at the locations X and Y.

The absolute velocity $c_x$ is obtained at the location X from the circumferential velocity $u_x$ of a blade 5 near the wall and from the return flow relative velocity $w_x$ of the partial load vortex PLV separating from the impeller. This absolute velocity is characterized by a high circumferential component $c_{ux}$. The arrows with the velocity information $c_4$ symbolize undisturbed oncoming flow to the impeller within the intake channel 9, with the blades 5 shown here in cross section with a profile.

In an analogous manner, a velocity triangle is drawn in at Y. This triangle prevails at the location Y in the area of the point of intake of the partial load vortex PLV into the impeller 2. Since the point of intake Y is on a smaller diameter, the circumferential velocity $u_y$ is correspondingly lower. And due to the fact that the energy of the partial load vortex PLV is weakened, its absolute velocity $c_y$ is also correspondingly lower, which yields a relative velocity $w_y$ which in this example is offset by 90° to a certain extent in relation to the relative velocity $w_x$ of an emerging current stream of the partial load vortex PLV.

Figure 6:
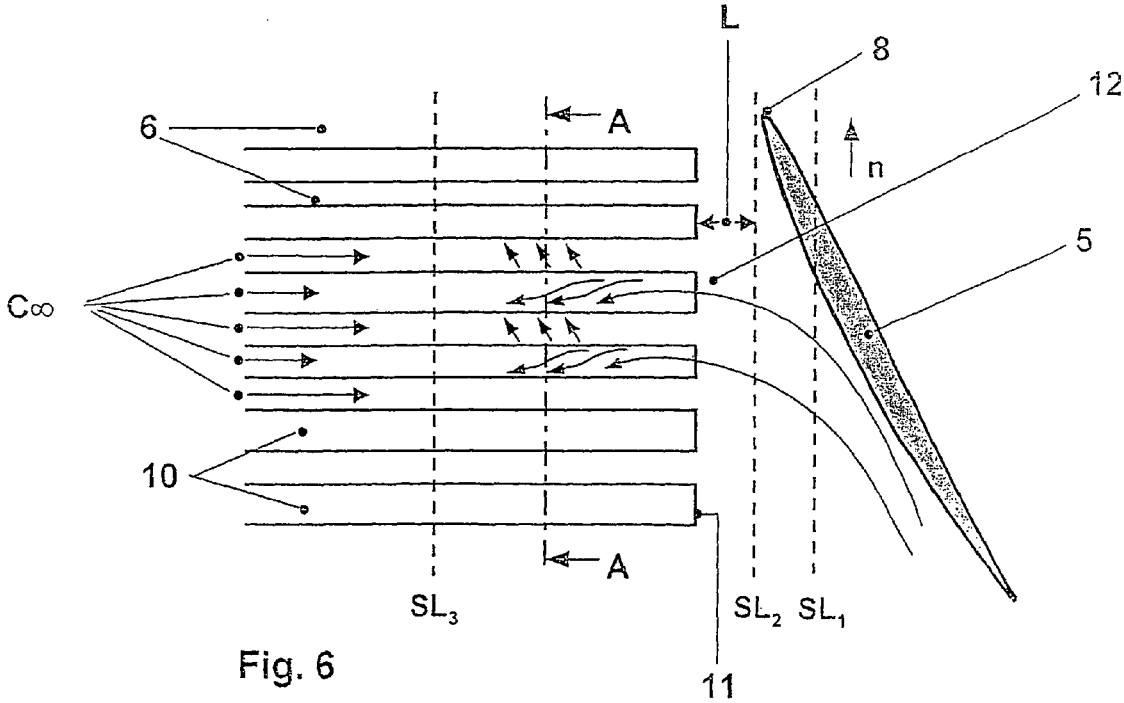
FIG. 6 is a diagram showing on the basis of a cylinder section the flow curves of a partial load vortex in the grooves.

In particular, the causative factor in the weakening of the partial load vortex PLV is the circumferential component $c_{ux}$ which leads to a tangential flow over the axially parallel grooves 10, as shown in FIG. 4 and in FIG. 6, which is a top view of a development of the housing wall 6. The outer blade ends 4 move constantly past this wall surface of the housing wall 6. In the housing wall 6, a plurality of grooves 10 are formed distributed around the circumference and extending in the direction of the oncoming flow to the impeller $c_\infty$. The groove ends 11 of the grooves 10 running in the direction of oncoming flow and arranged in the wall surface 6 of the intake channel 9 are situated at a distance in front of the blade intake edge 8 on the outside diameter D of the impeller 2. The beginning of these axially parallel grooves 10, i.e., grooves running in the direction of oncoming flow, is not shown here because the length of the grooves 10 is selected as a function of the delivery rates and the design of the impeller. The lengths of these grooves 10 vary in the range from 0.03 to 0.5 times the impeller intake diameter. In normal operation, an oncoming fluid flow will flow through the grooves 10 without having a negative effect on the operating performance of the centrifugal pump.

In addition, various separation lines $SL_1$, $SL_2$ and $SL_3$ are shown as dotted lines in FIG. 6. The separation lines $SL_1$, $SL_2$ show the limits on the intake end of a developing return flow region R in different operating states. In the range of the optimum point $Q_{opt}$ the separation line $SL_1$ is within the width of the impeller blades 5 and with increasing partial load operation, it migrates in front of the impeller or blade intake edge 8 up to the separation line $SL_2$. In normal operation, the position of this separation line $SL_2$ always remains in front of the impeller 2 in the area of a closed ring-shaped wall surface 12. This wall surface 12 ensures that the fluid material flowing back out of the region R cannot enter the grooves 10. The length L of the wall surface 12 extending from the impeller intake to the groove ends 11, as seen opposite the direction of oncoming impeller flow LA, is on an order of magnitude corresponding to the ratios of 0.005-0.02 multiplied by impeller intake diameter. In the example of an axial rotor used here, the impeller intake diameter usually corresponds to the impeller outside diameter D. In the case of a semiaxial impeller, it is correspondingly smaller, and with a closed impeller, it corresponds to the diameter up to the inside diameter of a cover disk 7.

Only when the partial load vortex PLV develops does the separation line $SL_2$ jump over the closed ring-shaped wall surface 12 and reach the wall surface 6 provided with the grooves 10. The separation line $SL_3$ forms the border of the axial extent of the partial load vortex PLV which then develops.

Thus when the partial load vortex PLV achieves a high energy accordingly, it jumps over the ring-shaped closed wall surface 12 situated in front of the impeller and flows back into the intake channel 9. Due to the absolute velocity component $c_{ux}$ running mainly in the circumferential direction, the partial load vortex PLV that develops in the intake channel 9 flows primarily tangentially over the grooves 10. In doing so, its swirl energy is dissipated in numerous small vortices which develop within the grooves 10. In the case of the partial load vortex PLV, this leads to a withdrawal of velocity energy so that the partial load vortex PLV becomes weaker on the whole and is greatly reduced in axial and radial extent. It therefore extends only up to the separation line $SL_3$ at which there is a reversal of flow of the partial load vortex PLV. Due to the simultaneous reduction in the spiral component of this partial load vortex, the stability of the characteristic line of the centrifugal pump at partial load is also improved significantly in addition to the reduction in the NPSH slope. The function of the grooves 10 is thus based on energy transfer by friction from a large pre-rotation vortex in the form of the partial load vortex PLV to multiple small vortices which develop in the grooves 10.

Figure 7:
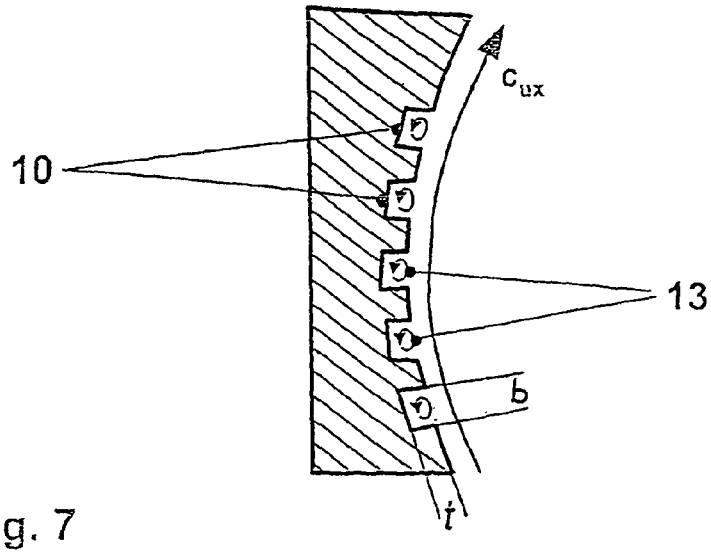
FIG. 7 is a diagram of the flow in the grooves.

In FIG. 7, which shows a section along line A-A in FIG. 6, the development of multiple energy-dissipating vortex systems 13 within the grooves 10 is depicted. The circumferential component $c_{ux}$ of the partial load vortex flow running tangentially to the direction of the groove is the causative factor for the numerous small vortex systems 13.

Figure 8:
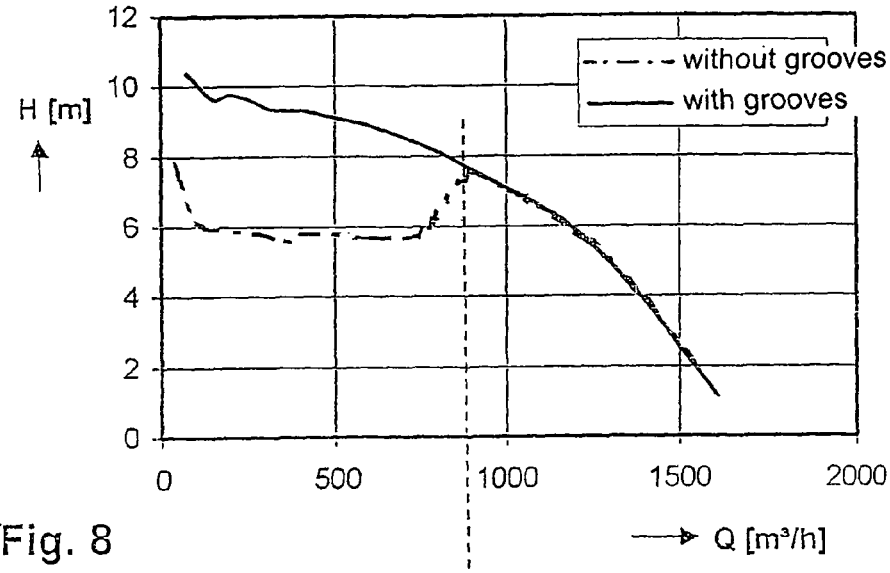
FIGS. 8 and 9 are graphs showing Q-H and NPSH curves with an improved characteristic.
Figure 9:
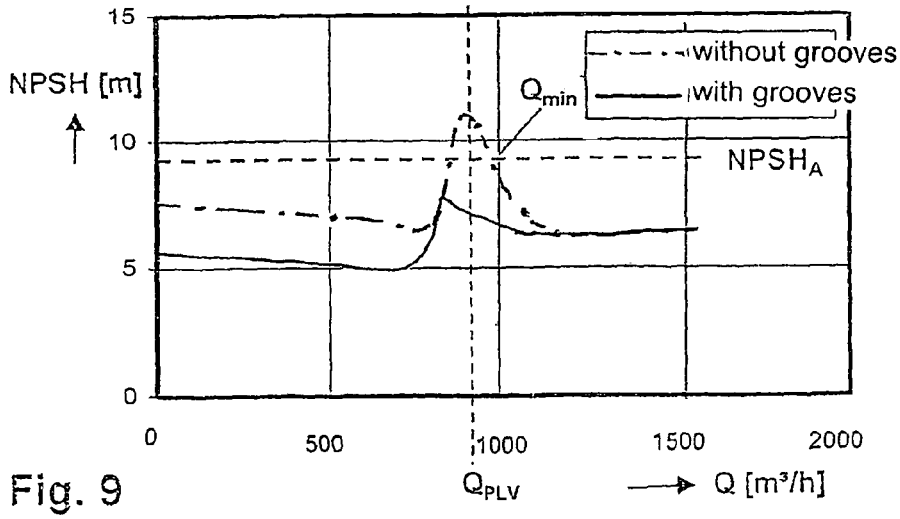

The paired diagrams in FIGS. 8 and 9 illustrate a comparison. In the diagram in FIG. 8, the curve shown with a dash-dot line corresponds to the Q-H characteristic curve of a centrifugal pump without grooves in the intake channel. Beyond the operating point $Q_{PLV}$ shown here, the Q-H curve has a definite break in the characteristic line. The delivery height decreases here toward smaller quantities. This is due to the effect of a partial load vortex PLV which develops here. However, the Q-H characteristic line, which is shown with a solid line, has a rising curve without a break in the characteristic line. This is the characteristic line of a centrifugal pump in which the intake channel has been provided with channels or grooves 10 ending a distance in front of the impeller. The dash-dot curve with a break in the characteristic line is due to the development of a partial load vortex and the resulting negative effects on the impeller oncoming flow.

However, with the same pump a characteristic curve represented by a solid line develops when grooves 10 are provided accordingly in front of the intake impeller in the wall surface 6 of the intake channel 9. The matching curve shapes in the normal operating range at the right of $Q_{PLV}$ prove convincingly the efficacy of the grooves in normal operation.

The respective NPSH curves are shown in FIG. 9, which is below FIG. 8. The NPSH curve which is shown with a dash-dot line corresponds to that of a pump whose intake channel 9 does not have any grooves. However, the solid characteristic line curve represents a pump whose intake channel 9 has multiple grooves 10. Due to the partial load vortex PLV, the effect of which is greatly reduced by the grooves 10, the NPSH behavior of such a pump is improved significantly. This NPSH curve no longer exceeds the specified system value $NPSH_A$ and thus no longer constitutes an NPSH-induced operating limit $Q_{min}$. The type of energy reduction of the partial load vortex PLV and the resulting reduction in the non-steady-state interaction result in improved flow conditions, especially in the operating range around PLV, as a result of which the NPSH behavior is improved and the pump characteristic line is stabilized.

It is thus the accomplishment of the inventors to have recognized that profiling in the form of grooves provided at a distance in front of the impeller in the intake opening/intake opening in the housing wall has a retarding effect only on a partial load vortex separating from the impeller in partial load operation. An additional surprising effect has been an unchanged noise characteristic of the centrifugal pump. Pumps that have already been shipped and installed into systems may thus be retrofitted with no problem because their noise level remains at the previous level.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A pump having a housing containing at least one impeller having an axial or semiaxial, open or closed design and an intake channel positioned in front of the first impeller, a plurality of fixed length grooves provided in the wall surface of said intake channel, said grooves being distributed around the channel circumference and extending in the direction of flow, wherein a fixed closed annular wall surface is provided in the housing wall of the intake channel between an impeller intake point of the first impeller and the proximate ends of the grooves, the closed annular wall surface forming an axial end of the grooves, whereby the grooves are operatively connected exclusively with the space in the intake channel.

2. The pump according to claim 1, wherein the grooves are arranged between rib-like projections of the housing wall.

3. The pump according to claim 1, wherein said grooves are formed in an insert.

4. The pump according to claim 3, wherein said insert is a thin-walled, annular element provided with grooves or ribs.

5. The pump according to claim 1, wherein said closed annular wall surface has an axial length which depends on the intensity of a partial load vortex and is between about 0.005 and about 0.02 times the impeller intake diameter.

6. The pump according to claim 1, wherein the grooves or ribs have a length between about 0.03 and about 0.5 times the impeller intake diameter.

7. The pump according to claim 1, wherein the grooves have a depth or the ribs have a height between about 0.005 and about 0.02 times the impeller intake diameter.

8. The pump according to claim 1, wherein the product of the number of grooves n times the width of the groove b corresponds to a ratio of $$n \cdot b = 0.45 - 0.65 \cdot \Pi \cdot D$$

where D is the impeller intake diameter.

9. A method of operating a pump to suppress partial load turbulence, comprising the acts of:

providing a housing containing at least one impeller having an axial or semiaxial, open or closed design and an intake channel positioned in front of the first impeller, a plurality of fixed length grooves provided in the wall surface of said intake channel, said grooves being distributed around the channel circumference and extending in the direction of flow, wherein a fixed closed annular wall surface is provided in the housing wall of the intake channel between an impeller intake point of the first impeller and the proximate ends of the grooves, the closed annular wall surface forming an axial end of the grooves, whereby the grooves are operatively connected exclusively with the space in the intake channel; and operating the pump at a partial load.

* * * * *